US005797464A

United States Patent [19]

Pratt et al.

[11] Patent Number: 5,797,464

[45] Date of Patent: Aug. 25, 1998

[54] SYSTEM FOR PRODUCING HIGH DENSITY, EXTRA LARGE WELL PERFORATIONS

[75] Inventors: Dan W. Pratt, Fort Worth; David S. Wesson, Waxahachie; Kevin R. George, Cleburne; James A. Rollins, Fort Worth, all of Tex.

[73] Assignee: Owen Oil Tools, Inc., Fort Worth, Tex.

[21] Appl. No.: 847,244

[22] Filed: May 1, 1997

Related U.S. Application Data

[63] Continuation of Ser. No. 601,105, Feb. 14, 1996, abandoned.

[51] Int. Cl.[6] ..... E21B 43/11

[52] U.S. Cl. ..... 175/4.6

[58] Field of Search ..... 175/4.6, 4.51, 175/4.54, 4.55, 4.57; 166/297; 102/310, 318

[56] References Cited

U.S. PATENT DOCUMENTS

| | | | |
|---|---|---|---|
| 4,312,273 | 1/1982 | Camp . | |
| 4,326,462 | 4/1982 | Garcia et al. . | |
| 4,523,650 | 6/1985 | Sehnert et al. . | |
| 4,583,602 | 4/1986 | Ayers | 175/4.52 |
| 4,598,775 | 7/1986 | Vann et al. . | |
| 4,609,057 | 9/1986 | Walker et al. | 175/4.6 |
| 4,655,138 | 4/1987 | Regalbuto et al. | 175/4.6 X |
| 4,694,754 | 9/1987 | Dines et al. . | |
| 4,726,431 | 2/1988 | Oestreich et al. | 175/4.6 |
| 4,739,707 | 4/1988 | Regalbuto et al. | 175/4.6 X |
| 4,771,827 | 9/1988 | Barker et al. . | |
| 4,844,170 | 7/1989 | Gill | 175/4.6 X |
| 4,850,438 | 7/1989 | Regalbuto | 175/4.56 |
| 4,889,183 | 12/1989 | Sommers et al. | 175/4.6 X |
| 5,323,684 | 6/1994 | Umphries | 175/4.6 X |
| 5,598,891 | 2/1997 | Snider et al. | 166/308 |

*Primary Examiner*—Frank Tsay
*Attorney, Agent, or Firm*—Charles D. Gunter, Jr.

[57] ABSTRACT

A shaped charge and liner having a minimum outside diameter determined by the formula:

$$D_L=2.625-0.3571(6-D_{ID})$$

Where:

$D_L$=Liner Minimum Outside Diameter $D_{ID}$=Carrier Inside Diameter

The geometry of the shaped charge reduces the chances of interference between charges by controlling burn time, as does the positioning of the primer cord. The liner has an open end with a minimum outside diameter determined by the formula. The shape of the case and liner is determined by keeping the center of the primer cord a distance not greater than 0.10 ($D_{ID}$) from the center line of the carrier, ideally not greater than 0.05 ($D_{ID}$). This yields a large diameter, flat shaped charge that may be loaded in a tubular carrier having a charge or perforation density of at least 10 shots per foot.

4 Claims, 3 Drawing Sheets

SYSTEM FOR PRODUCING HIGH DENSITY, EXTRA LARGE WELL PERFORATIONS

This a continuation of application Ser. No. 08/601,105, filed Feb. 14, 1996 now abandoned.

BACKGROUND OF THE INVENTION

1. Field of the Invention

The present invention relates to perforating systems having specially adapted guns used to support explosive charges in a borehole to form perforations through which water, petroleum or minerals are produced.

2. Background Information

Standard "big hole" shaped charges, used for perforating oil and gas wells, are arranged in tubular guns that typically range from 2⅞" O.D. to 7" O.D., with shot densities from 4 shots per foot to as high as 16 shots per foot. The purpose of a "big hole" charge is to produce the largest perforation possible to enhance the inflow of hydrocarbons into the well bore. The larger the entrance hole, the larger the cross-sectional flow area, and therefore the less the restriction to the injection of gravel pack sand and to the inflow of hydrocarbons into the bore hole of an oil well. Typically, big hole charges have been designed to fit existing gun systems that are, or originally were, used with deep penetrating (DP) charges. A DP charge creates a narrow opening that extends a greater distance into the formation. This established a limiting factor in the design of big hole perforating guns, preventing the big hole charges from being sized and oriented (phased) to yield the largest possible entry holes.

There are factors in achieving a successful large diameter perforation hole that prevent the mere substitution of a larger shaped charge in a prior art gun. The typical prior art shaped charge case, liner and explosive geometry, if simply made proportionally larger in a high density pattern is likely to cause interference, which is a disruption of the burn of one charge by the detonation of another charge. In a typical deep penetration (DP) charge, the detonation or burn time of one charge may be 50 microseconds, for example, to achieve a penetration depth of 25 inches. If another charge detonation causes interference, the burn time of the first charge may be decreased to 25 microseconds and the depth of penetration reduced to 12 inches. Interference is a function of charge size, charge density and the length of primer cord that extends between charges. The chances for interference increase when larger diameter charges are substituted for smaller charges, especially in the high density guns. There is a trend toward using guns having a higher shaped charge density, which is measured in charges per foot. There exist a need for high density guns that use shaped charges to produce larger diameter perforations that, when detonated, will not cause interference.

SUMMARY OF THE INVENTION

The general object of the invention is to provide an improved perforating system that utilizes large diameter shaped charges that are configured and positioned in a tubular carrier to achieve large high density, relatively deep perforations, without interference between detonating charges.

This object is achieved by using a shaped charge and liner having a minimum outside diameter determined by a formula derived for the invention. The liner has an open end with a minimum outside diameter determined by the formula:

$$D_L=2.625-0.3571(6-D_{ID})$$

Where:

$D_L$=Liner Minimum Outside Diameter $D_{ID}$=Carrier Inside Diameter

The geometry of the shaped charge reduces the chances of interference between charges by controlling burn time, as does the positioning of the primer cord. The shape of the case and liner is determined by keeping the center of the primer cord a distance from the center line of the carrier that is not greater than 0.10 ($D_{ID}$) or ten percent of the carrier inside diameter, ideally not greater than five percent. This yields a large diameter, flat shaped charge that may be loaded in a tubular carrier having a charge or perforation density of at least 10 shots per foot.

The above as well as additional objects, features, and advantages of the invention will become apparent in the following detailed description.

DETAILED DESCRIPTION OF THE INVENTION

Figure 1:
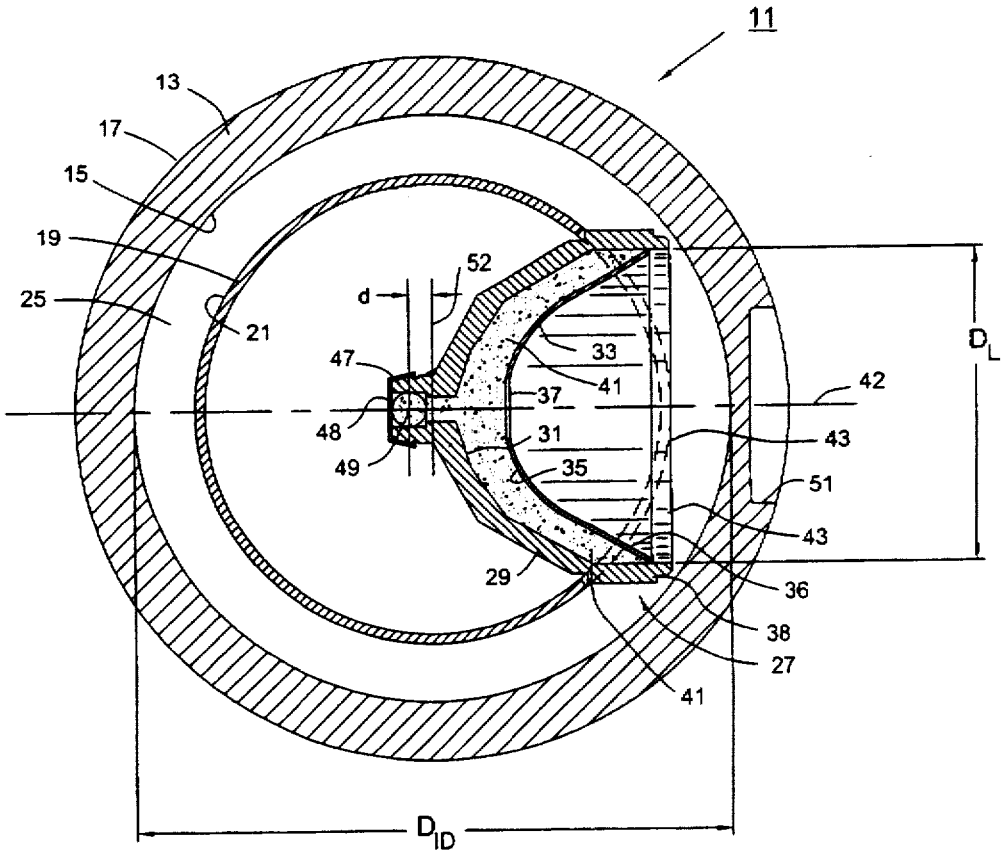
FIG. 1 is a cross-sectional view of a high density well perforating gun, including a shaped charge, a charge tube in which it is mounted and a tubular carrier.

Referring initially to FIG. 1 of the drawings, the numeral 11 illustrates in a cross section a perforating gun with a tubular carrier 13 having an interior cylindrical wall 15 and an exterior cylindrical surface or wall 17. A charge tube 19 is a concentric cylinder within the interior surface 15 of the carrier 13. The diameter of the annular outside surface 21 of the charge tube 19 is such that a selected annular space 25 is created.

A shaped charge 27 has a frusto-conical charge case 29 with an interior surface 31. A concave explosive material liner 33 with an interior surface 35 has an open end or base 36 attached to the base 38 of the charge case or tube 29 and extends inside of the charge case 29. The liner 33 base 36 has a selected outside diameter, $D_L$. A firing plate 37 forms the nose of the liner 33. Explosive material 41 is located in the area defined by the interior surface 31 of the charge case 29 and the combination liner 33 and firing plate 37. A charge cover 43 encloses the frusto-conical space formed by the explosive material liner 33 and the firing plate 37. An annular fastening ring (not shown) is located near the base of the charge case 29 in the prior art manner. Located at the nose end of the charge case 29 are a pair of ears 47 that extend outwardly from the charge case 29 in a parallel fashion to accept a primer cord 49.

A circular exterior wall bore 51 is located in the carrier 13 of the perforating gun 11, with a diameter less than that of the charge cover 43, at a selected depth from the outside edge of the cylindrical exterior wall 17. The exterior wall bore 51 is concentric about the center line 42 of the liner 33 and charge case 29.

The liner 33 outside diameter has a minimum dimension, $D_L$, determined by the following formula, which was derived for this invention:

$$D_L=2.625-0.3571(6-D_{ID})$$

Where:

$D_L$=Liner Minimum Outside Diameter $D_{ID}$=Carrier Inside Diameter

The center of the primer cord 49 is located as close as possible to the line 52 containing longitudinal axis of the charge tube 19, with the deviation or distance "d" minimized to achieved the ideal large perforation. Ideally, the primer cord 49 resides on the center line of the carrier 13 and concentric charge case 29 to avoid interference between detonating charges. The center of the primer cord is located a distance from the center line of the carrier that is not greater than 0.10 $D_{ID}$ or ten percent of the carrier inside diameter, ideally not greater than five percent. The shape of the case 29, liner 33 and explosive material 41 is therefore flattened, compared to prior art shapes to accomplish this goal.

The shaped charge 27 is inserted into the charge tube 19 and held in place by the fastener ring (not shown) with a pressure fit into fastener ring slot (not shown) in the prior art fashion. The primer cord 49 is fed through the ears 47 and retained by a clip 48 secured to the ears 47 of the charge case 29.

Figure 2:
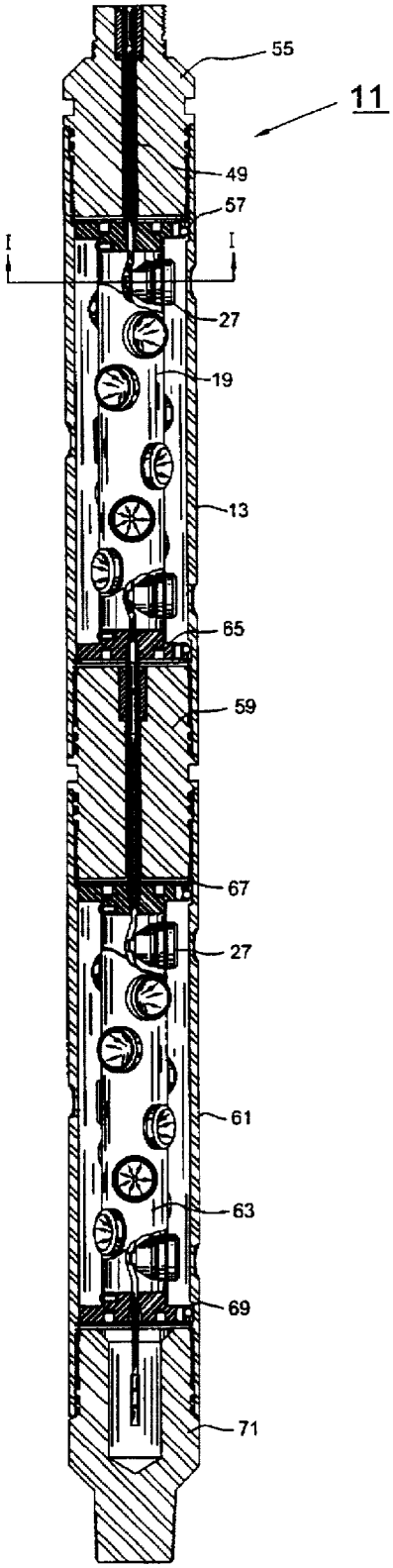
FIG. 2 is a side view, partially in section, showing the assembly from which the cross-sectional view of FIG. 1 is taken.

As indicated in FIG. 2, there are a plurality of shaped charges 27 mounted at selected angular and linear orientations (or phases) in the charge tube 19 that is concentrically mounted within the tubular carrier 13 of the perforating gun system 11. The tubular carrier 13 is sealingly supported by a top sub 55 that adapts to TCP or wireline systems. An end plate 57 supports the charge tube 19 concentrically within the carrier 13. In this preferred embodiment, a tandem sub 59 connects the tubular carrier 13 with a lower tubular carrier 61, within which is concentrically located a second charge tube 63 and a plurality of shaped charges 27. Additional end plates 65, 67, 69 secure respective ends of the charge tube 19 and the charge tube 63. A bull plug 71 defines the lower end of the gun. The primer cord 49 extends centrally through the top sub of 55, tandem sub 59 and into the bull plug 71, after being threaded through and retained in the ear 47 of each shaped charge 27, as indicated in FIG. 1.

Figure 3:
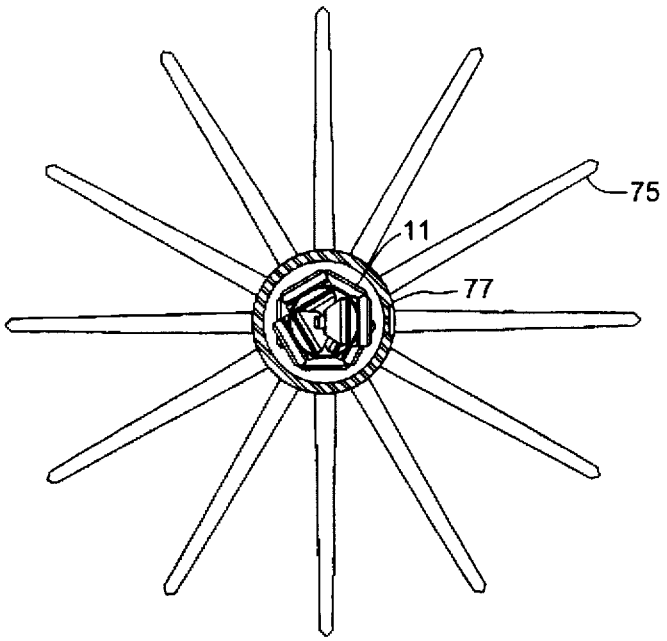
FIG. 3 is a schematic cross-sectional view of the assembly of FIG. 2 to illustrate a preferred shaped charge orientation or phase and the perforations produced upon detonation of the shaped charges.
Figure 4:
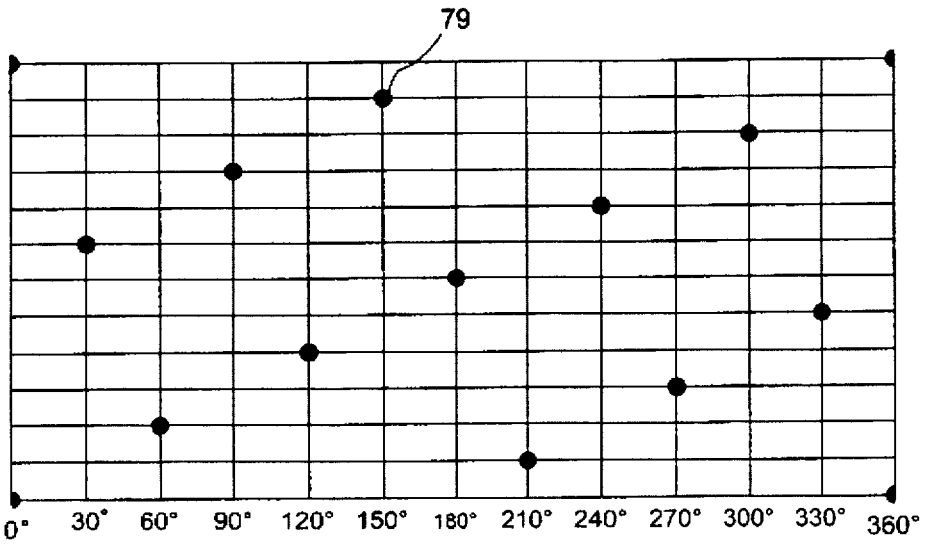
FIG. 4 is a phase diagram showing the angular and vertical orientation of the shaped charges of FIG. 2.

As shown in FIG. 3, a plurality of perforations 75 are formed in the earth through a casing 77 into which the perforating gun 11 is positioned. As indicated in both FIG. 3 and in FIG. 4, the perforations here are positioned at points 79 in a 30 degree phase relationship and are positioned linearly in each twelve-inch or one-foot section of casing, as indicated in FIG. 4.

Based on the formula above, the following representative relationships, but not limitations, have been established to correlate the carrier inside diameter $D_{ID}$ with the liner minimum outside diameter $D_L$.

| Nominal $D_{ID}$ (Inches) | $D_L$ (Inches) |
|---|---|
| 2.500 | 1.365 |
| 2.625 | 1.425 |
| 3.125 | 1.643 |
| 3,750 | 1.825 |

-continued

| Nominal $D_{ID}$ (Inches) | $D_L$ (Inches) |
|---|---|
| 4.000 | 1.910 |
| 5.000 | 2.270 |
| 6.000 | 2.615 |

Using the above criteria resulted in the development of several big hole gun systems that produce the largest perforations and the highest cross-sectional flow area that are commercially available. Typical 4½ inch, 12 to 16 shot-per-foot big hole gun systems produce casing holes averaging 0.70". This yields cross-sectional flow areas of between 4.618 and 6.158 square inches respectively. By using the system of the present invention, the resulting 4½ inch, 12 shot-per-foot, super big hole system produces an average 0.94" hole in the casing for an inflow area of 8.328 square inches. This is a 35% increase in inflow over the 16 shot-per-foot system. At 13 shots per foot the same charge system will yield 9.022 square inches for an additional 11.51% flow area. Hole sizes of 1.00" or greater are possible with the present invention in the 4½" gun configuration.

While we have shown our invention in only one of its forms, it is not thus limited but is susceptible to various changes and modifications without departing from the spirit thereof.

We claim:

1. An improved tubular perforating system used to complete wells, comprising:

a tubular carrier adapted to be lowered into or raised from an oil well;

a tubular charge tube adapted to be mounted generally concentrically within the tubular carrier;

a plurality of shaped charges mounted at sequential elevations and angular orientations in the charge tube to form, when detonated, a selected pattern of perforations in said well said pattern of perforations being characterized by a perforation density of at least ten shots per foot;

a primer cord connected with each shaped charge inside the charge tube;

each shaped charge having a generally frusto conical case;

each said case having an arcuate liner to confine an explosive charge against the interior of the case, the liner having an open end facing the wall of the charge tube with a selected minimum outside diameter determined by the following formula:

$$D_L=2.625-0.3571\ (6-D_{ID})$$

Where:

$D_L$=Liner Outside Diameter $D_{ID}$=Carrier Inside Diameter.

2. The invention defined by claim 1 wherein the center of the primer cord is positioned from the center line of the carrier at a distance not greater than 0.1 $D_{ID}$.

3. In an improved tubular perforating system used to complete wells, the improvement comprising:

a tubular carrier adapted to be lowered into or raised from an oil well;

a tubular charge tube adapted to be mounted generally concentrically within the tubular carrier;

at least one shaped charge having a generally frusto conical case secured to the tubular charge tube at a selected stand-off from the tubular carrier;

said case of said at least one shaped charge having an arcuate liner to confine an explosive charge against the interior of the case, the liner having an open end facing the wall of the charge tube with a selected minimum outside diameter determined by the following formula:

$$D_L=2.625-0.3571\ (6-D_{ID})$$

Where:

$D_L$=Liner Outside Diameter $D_{ID}$=Carrier Inside Diameter; and wherein said at least one shaped charge can be mounted in a tubular charge tube with other shaped charges to form, when detonated, a selected pattern of perforations in said well, said pattern of perforations being characterized by a perforation density of at least ten shots per foot.

4. The invention defined by claim 3 wherein the center of the primer cord is positioned from the center line of the carrier at a distance not greater than 0.1 $D_{ID}$.

* * * * *